US006389862B1

(12) United States Patent
Kusters

(10) Patent No.: US 6,389,862 B1
(45) Date of Patent: May 21, 2002

(54) METHOD FOR DEBASING COINS, DEVICES SUITABLE FOR CARRYING OUT SUCH A METHOD AS WELL AS DEBASED COINS

(75) Inventor: Wilhelmus Martinus Anthonius Kusters, Venlo (NL)

(73) Assignee: Syntech Holdings B.V. (NL)

( * ) Notice: Subject to any disclaimer, the term of this patent is extended or adjusted under 35 U.S.C. 154(b) by 0 days.

(21) Appl. No.: 09/647,870

(22) PCT Filed: Apr. 8, 1999

(86) PCT No.: PCT/NL99/00212

§ 371 Date: Nov. 22, 2000

§ 102(e) Date: Nov. 22, 2000

(87) PCT Pub. No.: WO99/52638

PCT Pub. Date: Oct. 21, 1999

(30) Foreign Application Priority Data

Apr. 9, 1998 (NL) ..... 1008854
Nov. 11, 1998 (NL) ..... 1010532

(51) Int. Cl.[7] ..... B21B 21/00
(52) U.S. Cl. ..... 72/197; 241/235
(58) Field of Search ..... 72/196, 197, 198; 241/227, 235, 236, 242, 243

(56) References Cited

U.S. PATENT DOCUMENTS 3,686,917 A * 8/1972 Hikida et al. ..... 72/196
5,950,475 A * 9/1999 Penny ..... 72/197

FOREIGN PATENT DOCUMENTS

DE 19901790 * 7/2000 ..... B02C/18/06
GB 2063735 * 6/1981 ..... 72/196
GB 2098525 * 11/1982 ..... 72/196

* cited by examiner

*Primary Examiner*—Ed Tolan
(74) *Attorney, Agent, or Firm*—Seed Intellectual Property Law Group PLLC

(57) ABSTRACT

A method for debasing coins, wherein each coin is mechanically deformed by feeding the coin between at least two rolls (6, 7) or assemblies rotating in opposite directions. The coins are deformed into a corrugated shape, flattened out or shredded. The device comprises at least two rolls (6, 7) or assemblies which are rotatable in opposite directions, a feeding device (3) for feeding coins to be debased to said rolls or assemblies and a discharge device (8) for carrying the debased coins away from said rolls or assemblies.

17 Claims, 8 Drawing Sheets

METHOD FOR DEBASING COINS, DEVICES SUITABLE FOR CARRYING OUT SUCH A METHOD AS WELL AS DEBASED COINS

This application is a 35 USC 37, of PCT/NL99/00212 filed Apr. 8, 1999.

The invention relates to a method for debasing coins.

The invention furthermore relates to a device suitable for carrying out such a method as well as to coins that have been debased by means of such a method.

The debasing of coins, for example when coins are taken out of circulation in order to be replaced by new coins or other coins, such as the Euro, involves the destruction of these old coins. So far this has been done by melting the coins in a melting furnace. Melting coins directly has a number of drawbacks, however. When coins are fed to a melting furnace, a number of persons must be present to supervise the process to ensure that all the coins are indeed fed to the melting furnace. Besides, coins have an alloy composition which is different from alloy compositions which are used for other purposes than for coins. It is not possible, therefore, to just feed the coins to a melting furnace which is in operation, the melting furnace must first be shut down and be cleaned, after which the coins can be melted, which is relatively laborious. In addition, the melting of coins will not be started before a relatively large amount of coins is present, since it is too costly to interrupt the normal melting process for a relatively small amount of coins. The drawback of this is, however, that the coins to be debased must be stored for some time before they are melted down. During this period the coins need to be stored in a guarded space.

A method for debasing coins or tokens is known from US-A-3.878.930. According to said method a brittle token, provided with an inner opening, is positioned in an aperture of slide. In the slide forces are excerted on said token to break it into pieces. Said forces are directed in a plane parallel to the plane of said token. Since each token needs to be positioned in a slide individually, the shredding of a number of tokens is relatively time consuming. The method according to US-A-3.878.930 is therefore not suitable to devaluate large amount of coins as will be necessary when changing from a national currency to the Euro.

The object of the invention is to provide a method and device by means of which the debasing of coins can take place in a relatively simple and quick manner whilst avoiding the drawbacks of the known method.

This objective is accomplished with the method according to the invention in that each coin is fed through at least two rolls rotating in opposite directions, whereby at least one roll is provided with a corrugated profile as a result of which the coins are deformed into a corrugated shape.

Damaging the coins by deforming them makes it possible to store the coins thus damaged until a suitable moment has arrived for melting down the damaged coins. Said damaging of coins can take place at the location where the coins are collected, for example at a central bank. The presence of several persons or authorized persons during the melting process is not required, since the coins no longer have a particular value. Furthermore it is possible to add a desired amount of coins, whose composition is known, to a melting process, so that a desired alloy is obtained. Furthermore it is possible to offer the damaged coins for sale elsewhere in the world as a raw material.

The coins can be provided with a corrugated profile, in a simple manner by means of said rolls, whereby a relatively large amount of coins can be debased from a random orientation in a relatively short period of time. The coins are fed through the device in a simple manner by the rotating rolls.

It has to be noted that from US-A-4.377.259 a method is known for shredding relatively large scrap metal parts into relatively small parts. Forces to cut or break metal parts are much higher then the forces necessary to deform metal parts. Debasing of coins by deforming them into a corrugated shape is not indicated nor suggested in US-A-4.377.259.

A device according to the invention is characterized in that said device comprises at least two rolls rotating in opposite directions, whereby at least one roll is provided with a corrugated profile, a feeding device for feeding coins to be debased to the rolls and a discharge device for carrying the debased coins away from the roll.

Coins can be fed to the rolls, be debased by said rolls and be carried away from said rolls relatively quickly by means of such a device. All coins are fed through said rolls, so that only debased coins will land in the discharge device.

The invention will be explained in more detail hereafter with reference to the drawings, in which.

Figure 2:
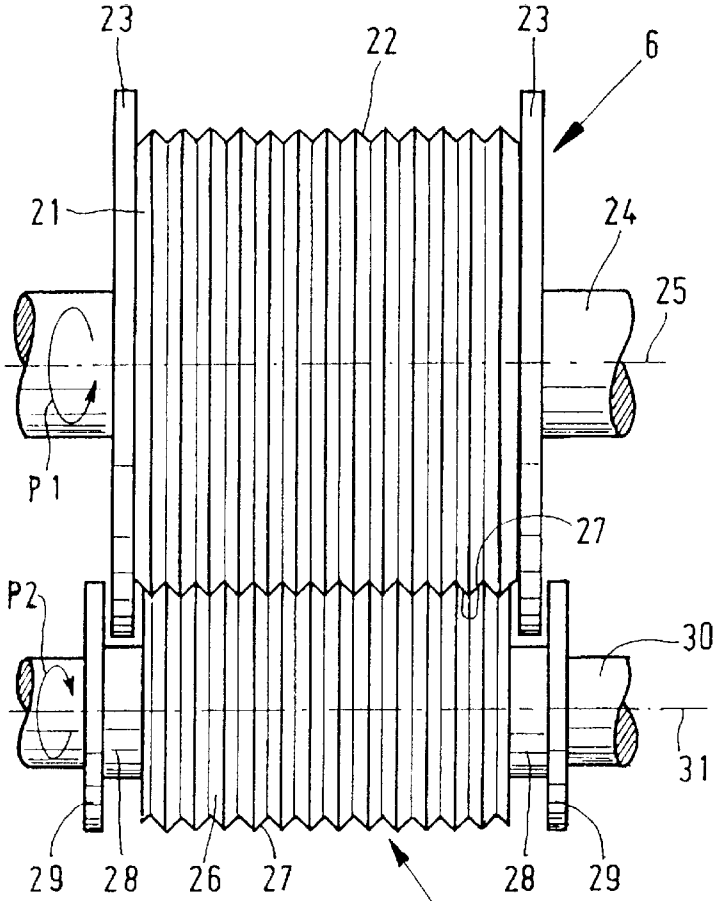
FIG. 2 is a plan view of rolls of the device as shown in FIG. 1.
Figure 5:
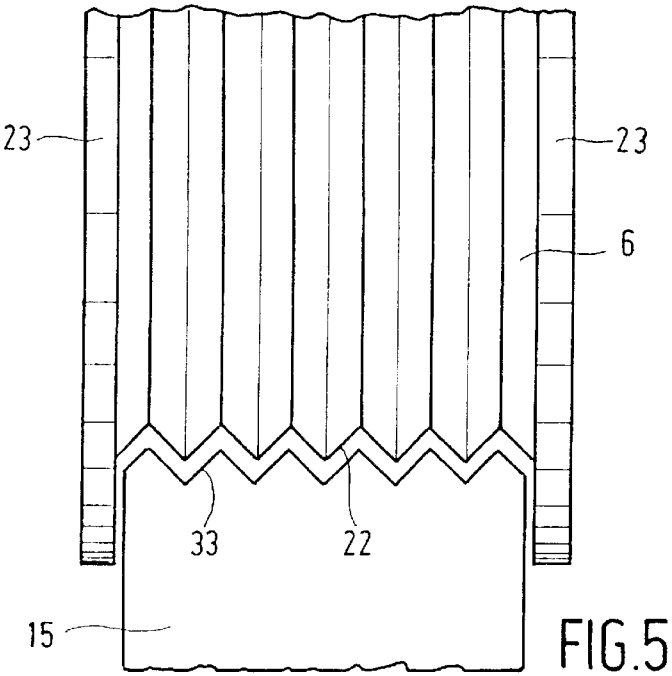
Figures 4A, 4B, 4C:
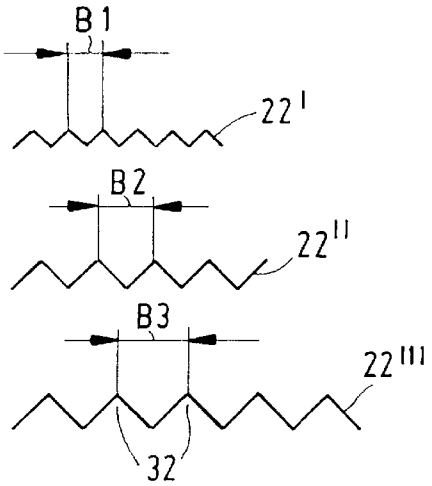
Figure 7:
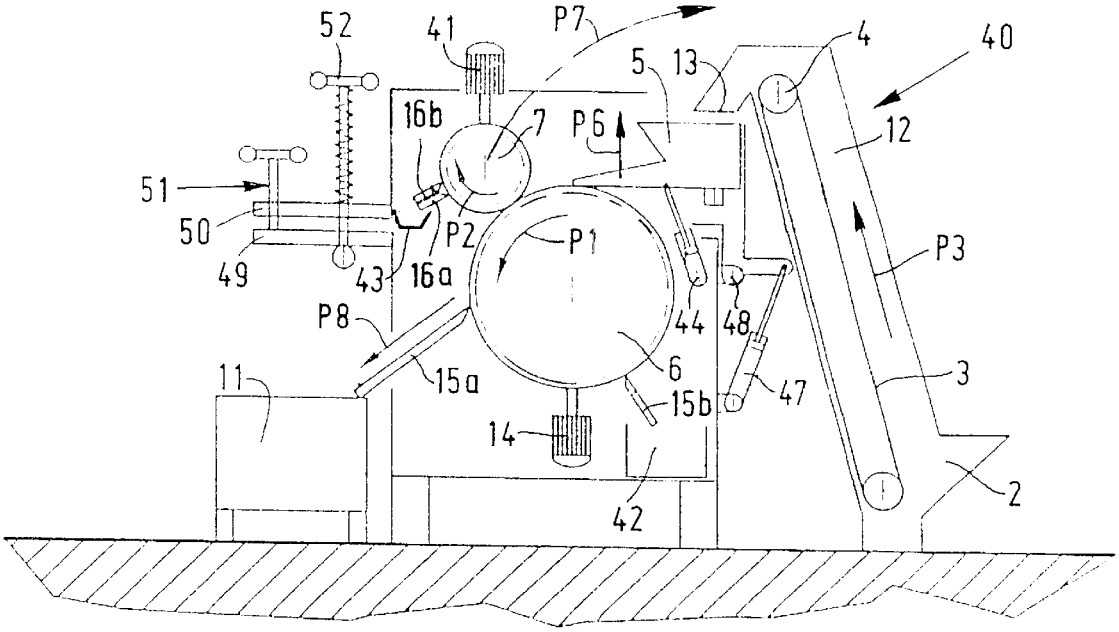
Figure 8:
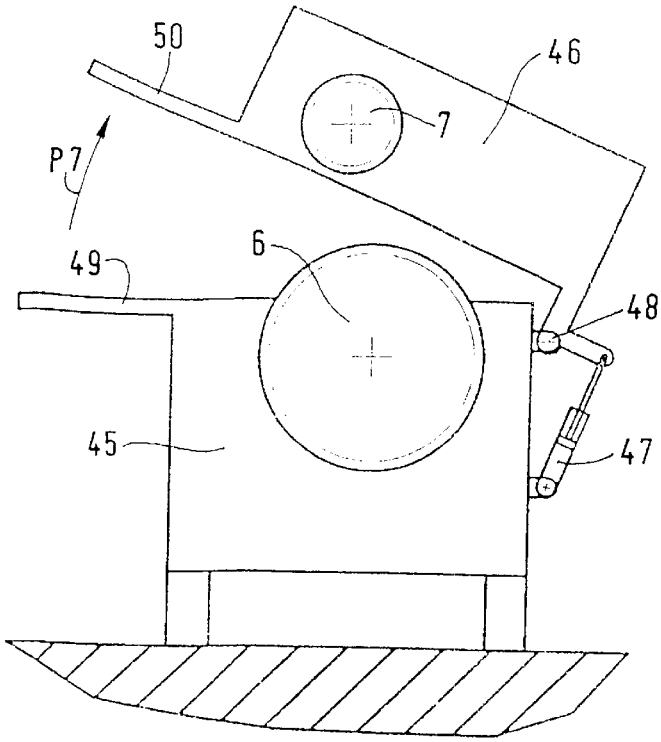
Figure 9A:
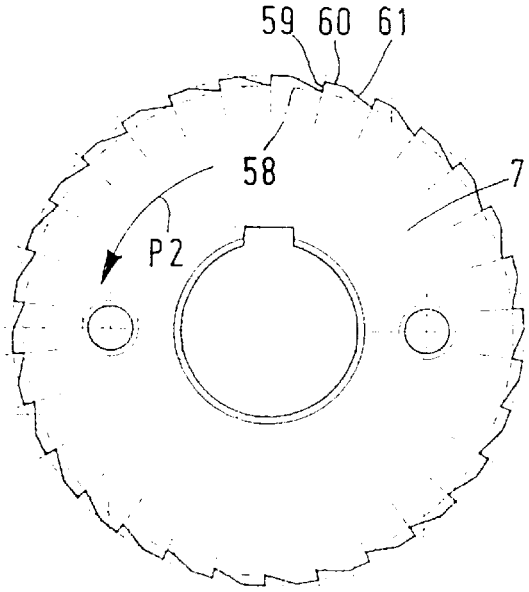
Figure 9B:
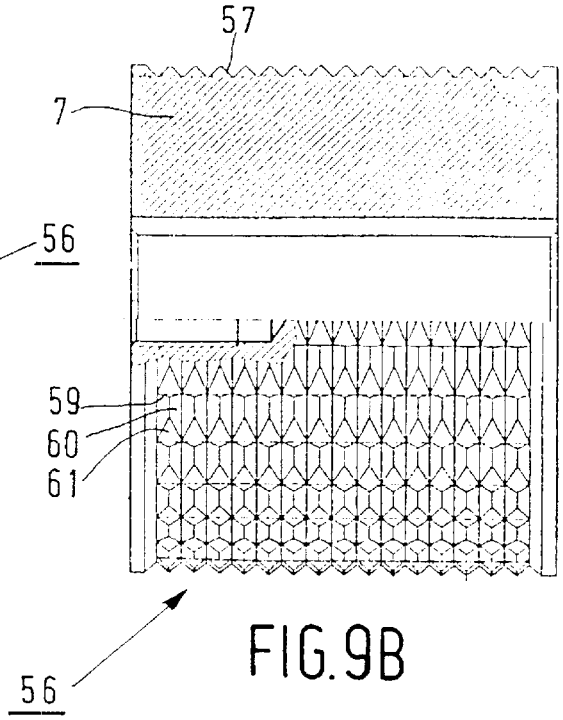
Figure 10:
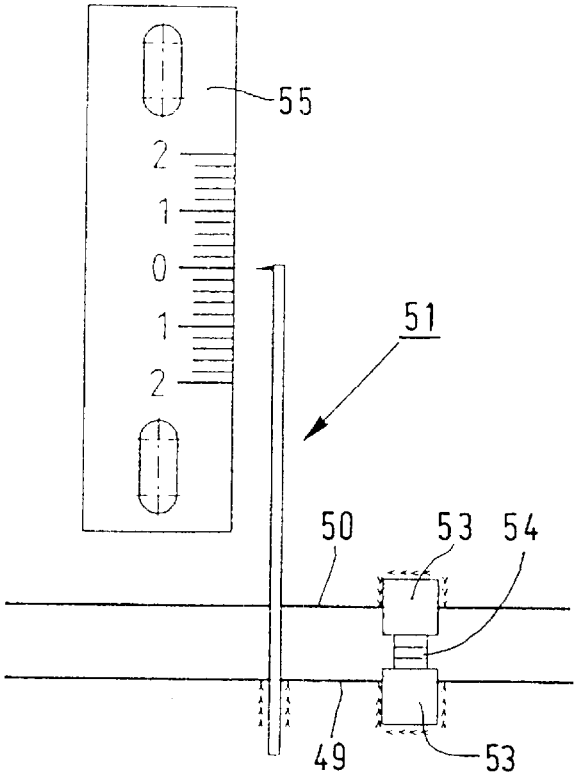
Figure 11:
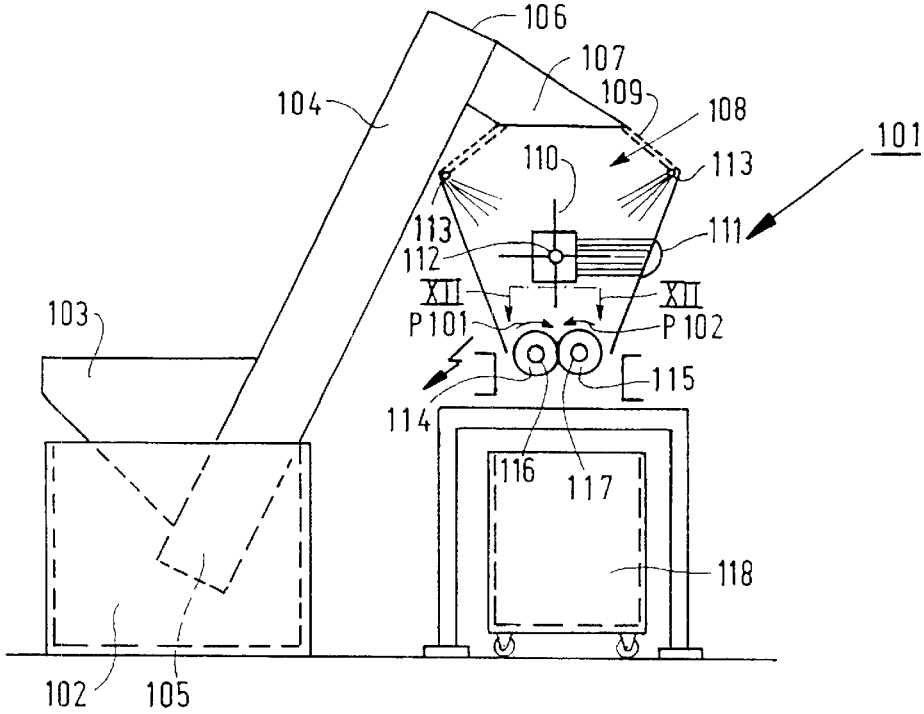
Figure 12:
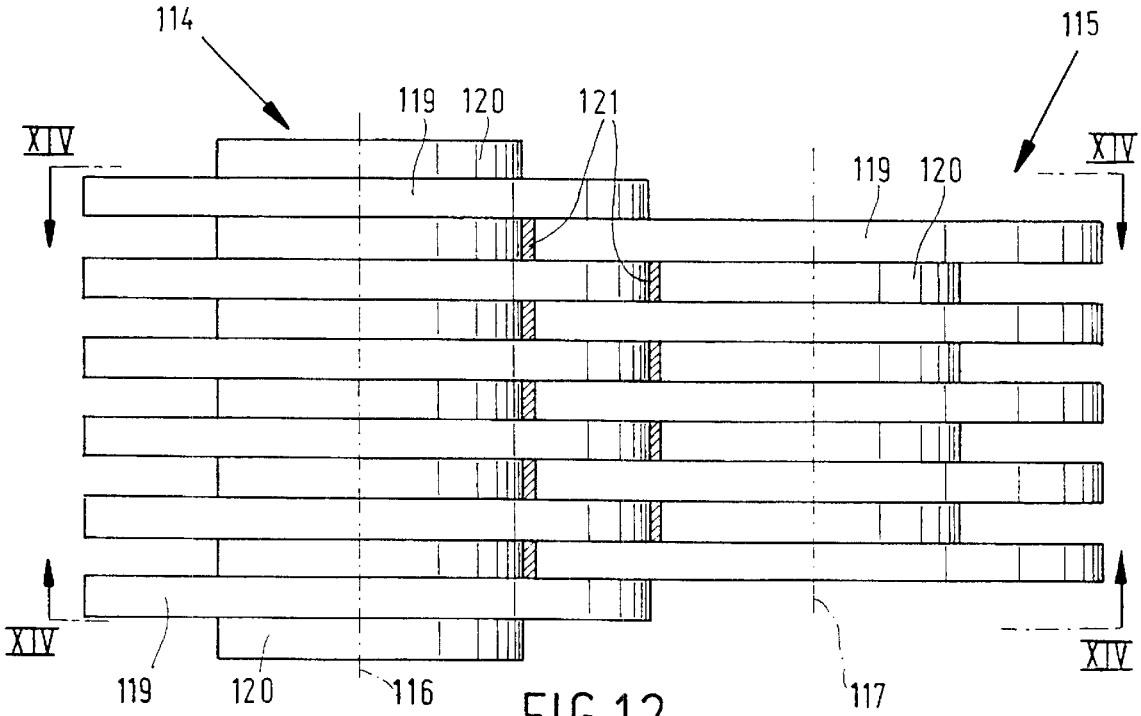
Figure 13:
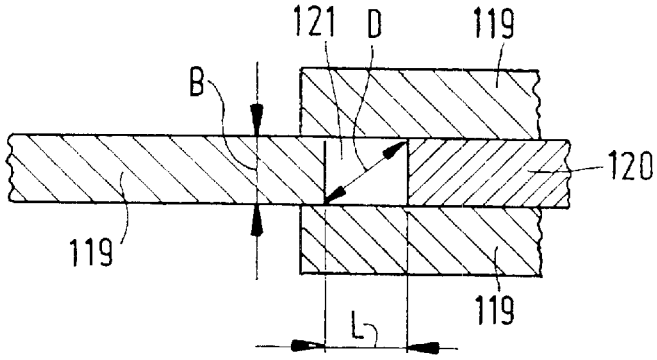
Figure 14:
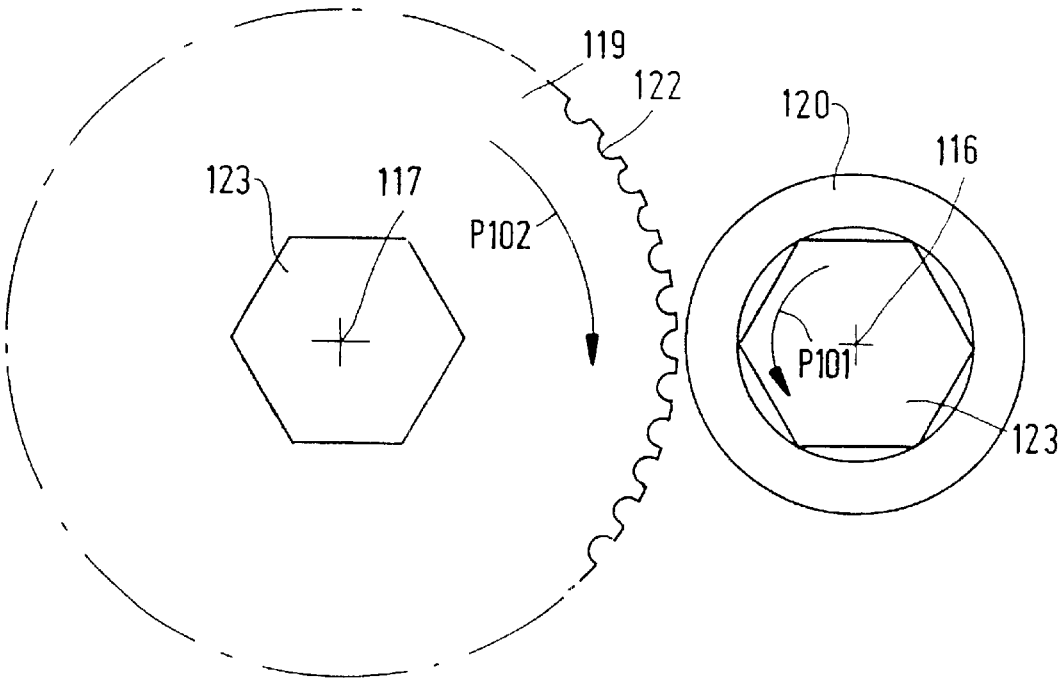
Figure 15:
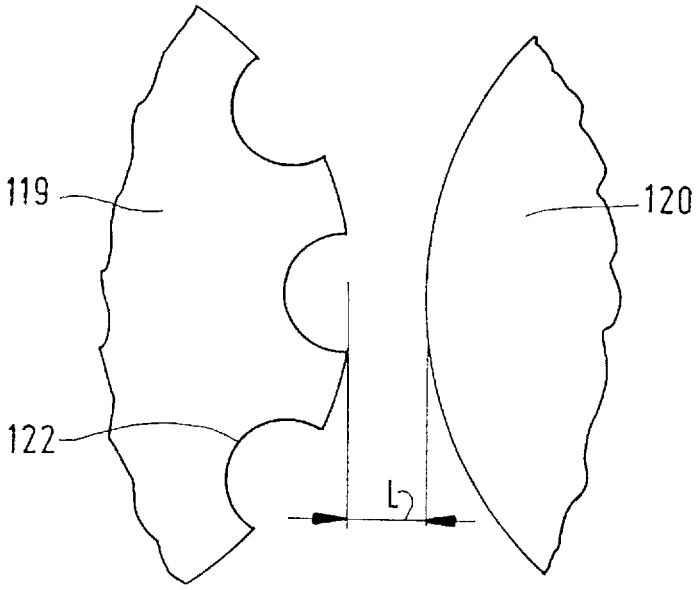

FIGS. 4A–C show various profiles of the rolls which are shown in FIG. 2;

FIG. 5 is a view of a roll and an associated scraper according to the invention;

FIGS. 6A and 6C, 6B and 6D are plan views and side views, respectively, of coins exhibiting a corrugated pattern;

FIG. 7 is a front view of a second embodiment of a device according to the invention;

FIG. 8 shows part of the device as shown in FIG. 7, in an open position thereof;

FIG. 9A is a side view of a roll of the device as shown in FIG. 7;

FIG. 9B shows the roll of FIG. 9A, partially in front view and partially in cross-sectional view;

FIG. 10 shows an adjusting mechanism of the device of FIG. 7;

FIG. 11 is a front view of a shredding device according to the invention;

FIG. 12 is a plan view of a part indicated by arrows XII—XII of the shredding device of FIG. 11;

FIG. 13 shows a detail of the plan view of FIG. 12;

FIG. 14 is a front view of the part shown in FIG. 12, seen in the direction indicated by arrow XIV—XIV;

FIG. 15 is an enlarged detail of the front view of FIG. 14; and

Figure 16:
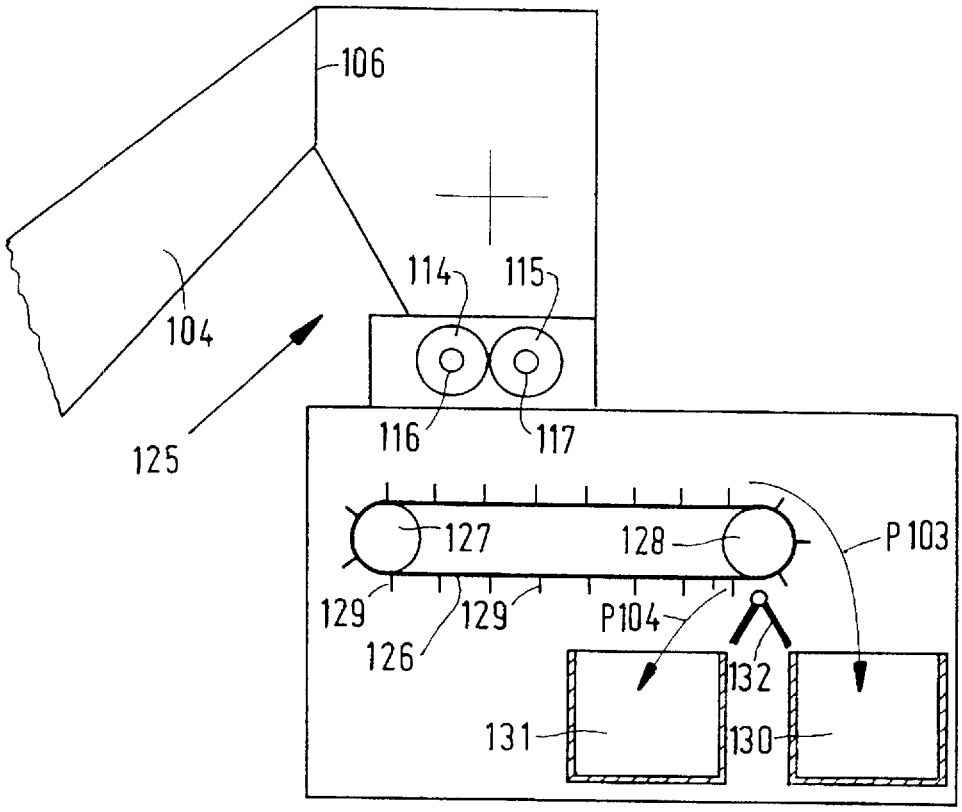

FIG. 16 shows another embodiment of a shredding device according to the invention.

Corresponding parts are indicated by the same numerals in the figures.

Figure 1:
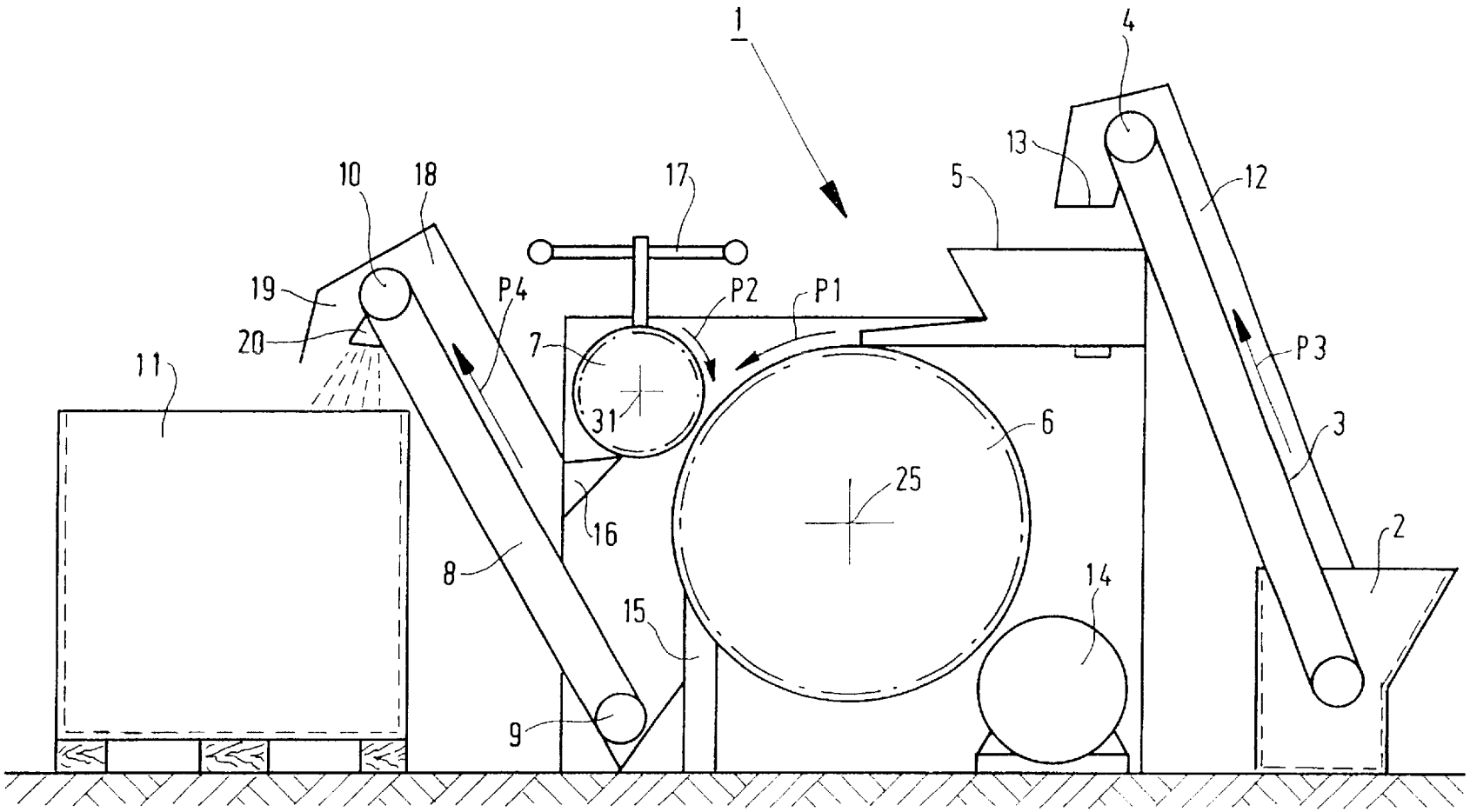
FIG. 1 is a front view of a device according to the invention.

FIG. 1 shows a device 1 according to the invention, which comprises a storage hopper 2 for the coins to be debased, a conveyor belt 3 which slopes upwards from storage hopper 2, a distributor 5 disposed under an upper end 4 of conveyor belt 3, a first roll 6 positioned under distributor 5, a second roll 7 positioned opposite first roll 6, an upwardly sloping conveyor belt 8, a lower end 9 of which is positioned under rolls 6, 7, and a container 11 disposed under upper end 10 of said upwardly sloping conveyor belt 8. Conveyor belt 3 is enclosed by a cover 12, which is provided near upper 4 with an opening 13 which opens above distributor 5. Roll 6 can be rotated in a direction indicated by arrow P1 by means of a motor 14. A scraper 15, which will be explained more fully with reference to FIG. 5, abuts against roll 6. Roll 7 can be rotated in a direction indicated by arrow P2, opposed to the direction indicated by arrow P1, by means of a motor (not shown). A scraper 16 abuts against roll 7. Roll 7 is vertically adjustable with respect to roll 6, either mechanically or manually, by means of an adjusting wheel 17. Conveyor belt 8 is provided with a cover 18, which opens above container 11 via an opening 19. A sensor 20 is provided near opening 19, which functions to detect the degree to which the container is filled.

FIG. 2 is a plan view of rolls 6, 7 of the device 1 as shown in FIG. 1. Roll 6 comprises a cylindrical drum 21, which is circumferentially provided with a toothed profile 22. Cylindrical drum 21 is bounded at its ends by disc-shaped flanges 23. Cylindrical drum 21 is connected, together with flanges 23, with a shaft 24 which is rotatable about an axis 25 in a direction indicated by arrow P1. Roll 7 comprises a cylindrical drum 26, which is externally provided with a toothed profile 27, which corresponds to the toothed profile 22 of roll 6. Cylindrical drum 26 is provided with a flange 28 at both ends, which flanges are disposed opposite flanges 23 of roll 6. Flanges 23 of roll 6 thereby extend to a position opposite ends of cylindrical drum 26. Flanges 28 are connected on a side remote from cylindrical drum 26 with flanges 29, which have a larger diameter and which partially extend parallel to flanges 23 of roll 6. Cylindrical drum 26 is connected, together with flanges 28, 29, with a shaft 29 which is rotatable about an axis 31 in a direction indicated by arrow P2.

Figure 3:
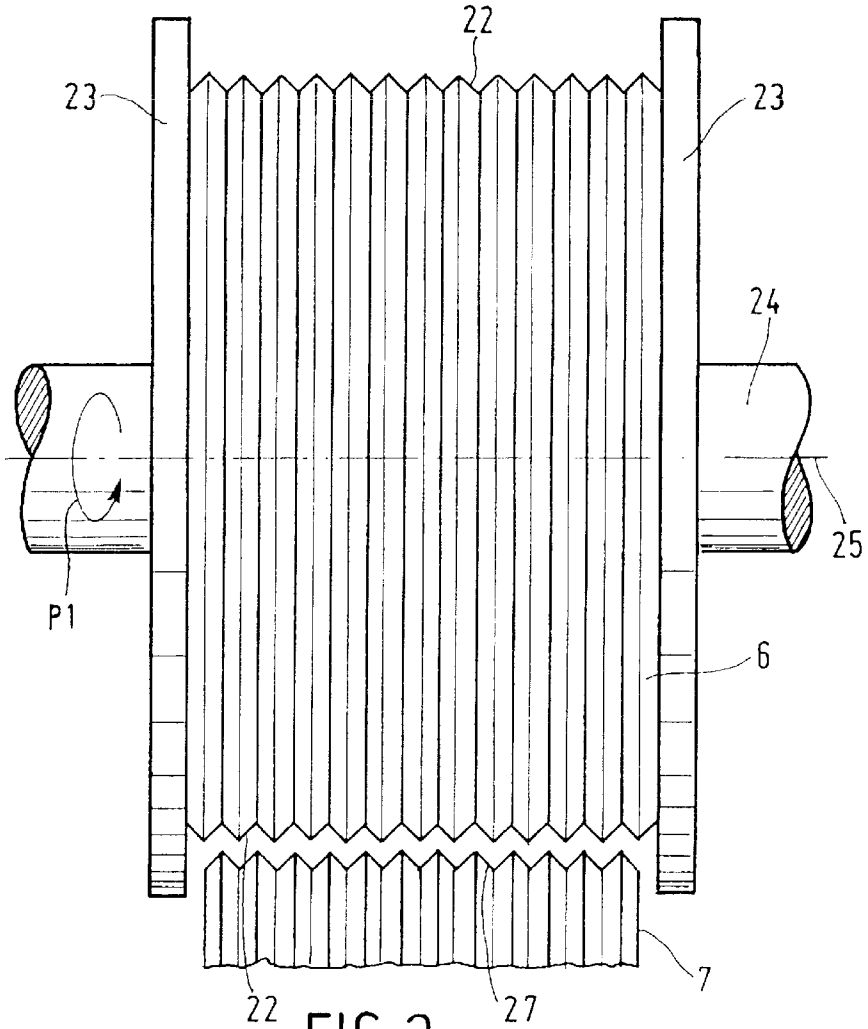
FIG. 3 is a plan view of a roll as shown in FIG. 2.

FIG. 3 is a larger-scale representation of roll 6 and of a part of the roll 7 positioned opposite thereto, with toothed profiles 22, 27 being clearly shown. Profiles 22, 27 extend along the entire circumference of rolls 6, 7. Profiles 22, 27 are positioned opposite each other in such a manner that when a coin to be debased is fed through rolls 6, 7, said coin is given a corrugated profile corresponding to profiles 22, 27.

FIGS. 4A–4C show three different profiles 22', 22", 22'", each figure showing a different distance B1, B2, B3 between two adjacent teeth 32 of profiles 22', 22", 22'", respectively. Profile 22' is in particular suitable for coins having a relatively small diameter, whilst profile 22'" is in particular suitable for coins having a relatively large diameter. Profile 22' is suitable for coins of practically any diameter.

FIG. 5 shows roll 6 and the scraper 15 that abuts against said roll. For easy reference, however, said scraper is spaced from roll 6 in the figure. Scraper 15 is provided with a profile 33 which corresponds to profile 22 of roll 6.

The operation of device 1 according to the invention will now be explained in more detail. Coins to be debased are transported from storage hopper 2 in the direction indicated by arrow P3 by means of conveyor belt 3, after which the coins land in distributor 5 via opening 13. From said distributor 5, the coins are fed to roll 6, which roll 6 will transport the coins in the direction indicated by arrow P1, whereby the coins will be fed through the rolls 6, 7. The opposed profiles 22, 27 will thereby give the coins a corresponding corrugated pattern. As a result of this, the coins will lose their original flat form. Due to the corrugated profile that the coins have been given, the coins can no longer be used as means of payment. Coins which are stuck in rolls 6, 7 are removed therefrom by means of scrapers 15, 16. The debased coins that have been fed through rolls 6, 7 land on conveyor belt 8 and are transported in the direction indicated by arrow P4 by means of conveyor belt 8. The debased coins land in a container 11 via opening 19 in the cover which encloses conveyor belt 8, by means of which container the debased coins can be transported to a melting furnace, for example. A sensor is used to detect whether container 11 is full and needs to be replaced by an empty container. The contents of a number of containers 11 filled with debased coins can be jointly melted down in a melting furnace.

Since the distance between rolls 6, 7 can be adjusted by means of the vertically adjustable roll 7, device 1 is suitable for processing coins of varying thickness. Profiles 22'–22'" exhibiting respective distances B1–B3 between teeth 32 can be selected in dependence on the desired degree to which a coin is to be deformed.

Figure 6D:
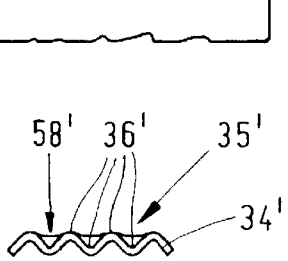
Figure 6C:
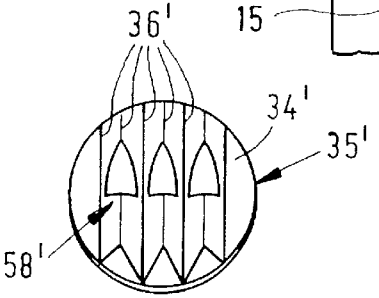
Figure 6B:
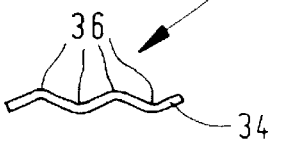
Figure 6A:
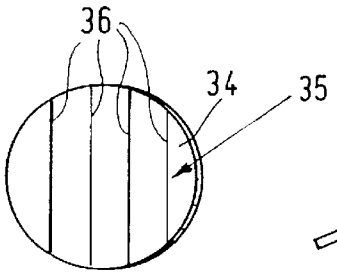

FIGS. 6A and 6B show a coin 34 which has been deformed by means of device 1 according to the invention, which coin exhibits a corrugated pattern 35. The corrugated pattern 35 of the coin which is shown in FIG. 6A comprises four folding lines 36. A coin 34 can be provided with fewer or with more folding lines 36, depending on the profile 22 that is selected.

FIG. 7 shows a second embodiment of a device 40 according to the invention, which in general corresponds to device 1 of FIG. 1. Device 40 comprises two rolls 6, 7 rotating in opposite directions, which can be individually rotated in and opposite to the directions as indicated by arrows P1 and P2 by means of a motor 14, 41. Positioned opposite roll 6 are two scrapers **15*a*, 15*b*, which scrapers also function as discharge plates to container 11 or to a receptacle 42. Positioned opposite roll 7 are scrapers 16*a*, 16*b*, which scraper 16*b* also functions as a discharge plate to a receptacle 43. Device 40 is furthermore provided with a piston/cylinder combination 44, by means of which distributor 5 can be adjusted in a direction indicated by arrow P6, and in the opposite direction, with respect to roll 6. As is shown more clearly in FIG. 8, roll 6 is rotatably journalled in a lower base part 45, whilst roll 7 is rotatably journalled in a part 46 disposed above said part 45. Part 46 can be pivoted about a pivot pin 48, inter alia by means of a piston/cylinder combination 47, in a direction indicated by arrow P7 and in the opposite direction. Furthermore, part 46 is movable against spring force in a direction indicated by arrow P7 and in the opposite direction, as will be explained in more detail as yet. Base part 45 and upper part 46 are each provided with a plate-shaped projection 49, 50, which projections extend substantially parallel to each other in the situation wherein rolls 6, 7 are positioned opposite each other, as is clearly shown in FIG. 7. Plate-shaped projections 49, 50 are provided with a spacing mechanism 51 and a biassing mechanism 52. Mechanism 51 is shown more clearly in FIG. 10, it comprises two blocks 53, between which a predetermined number of coins 54 to be deformed are placed. All the coins to be deformed must have the same thickness in order to ensure that all coins will be deformed upon being fed through rolls 6, 7. Device 51 is furthermore provided with a rule 55, from which a value representative of the thickness of the coins 54 to be deformed can be read. By spacing plate-shaped projections 49, 50, which are connected to parts 45, 46, the desired distance apart by means of spacing mechanism 51, also the rolls 6, 7 disposed in said parts 45, 46 will be spaced a desired distance apart. Biassing mechanism 52, which may for example comprise a spring pack or a piston/cylinder combination, can be used for exerting a predetermined desired force between plate-shaped projections 49, 50. Part 46 can be moved against said biassing force in the direction indicated by arrow P7**.

The operation of the device 40 which is shown in FIG. 7 corresponds in large measure to the operation of the device 1 which is shown in FIG. 1. The coins which have been deformed by rolls 6, 7 are carried directly to container 11 in the direction indicated by arrow P8 via scraper 15*a*. Coins which are stuck in the teeth of roll 6 are scraped off roll 6 by scraper 15*a*. Coins which are stuck in roll 7 after having passed rolls 6, 7 are scraped off roll 7 by scraper 16*a*, which coins will land in container 11 as yet via scraper 15*a*. If coins get wedged between rolls 6, 7 in such a manner that rolls 6, 7 cannot be rotated in the directions indicated by arrows P1, P2 any more, the feeding of coins will be stopped and rolls 6, 7 will be rotated at least one revolution in directions opposed to the directions indicated by arrows P1, P2. The coins which are present on rolls 6, 7 or between the teeth thereof can be removed from rolls 6, 7 by means of scrapers 15*b*, 16*b*, and be caught in receptacles 42, 43. The coins which are present in said receptacles 42, 43 must be added to storage hopper 2 anew in order to be debased as yet.

Before rolls 6, 7 can be rotated in directions opposed to the directions indicated by arrows P1, P2, however, distributor 5 must be moved in the direction indicated by arrow P6 by means of piston/cylinder combination 44. As a result of this, the coins present between the teeth of roll 6 and the coins present on roll 6 will not come into contact with distributor 5.

There is a chance that a number of coins will lie one on top of another upon being fed through rolls 6, 7. Rolls 6, 7 may thereby be moved a predetermined, maximum distance apart against the biassing force exerted by means of biassing mechanism 52. Device 40 may be provided with a device for monitoring the spacing of the rolls. When the spacing between rolls 6, 7 exceeds a predetermined, maximally allowed value, the feeding of coins will be stopped and rolls 6, 7 will be rotated in directions opposed to the directions indicated by arrows P1, P2. Thus, coins are prevented from passing through rolls 6, 7 without being deformed to a sufficient degree. In addition, rolls 6, 7 are prevented from being damaged in this manner in the event that undesirable parts, such as metal remnants, bolts and other coins that are too thick accidentally find their way into the device.

FIGS. 6C, 6D shows a coin 34' which has been deformed by means of device 40 according to the invention, which coin exhibits a corrugated pattern 35', folding lines 36' and imprints 58' of teeth 58 (see FIGS. 9A, 9B).

Roll 7 may have a profile similar to that of roll 7 of the device which is shown in FIG. 1. Preferably, however, roll 7 will have a profile as shown in FIGS. 9A, 9B. As is clearly shown in FIGS. 9A and 9B, profile 56 comprises grooves 57 extending in the circumferential direction of roll 7 and teeth 58 extending in axial direction. Teeth 58 each comprise a radially extending wall portion 59, a tangentially extending wall portion 60 adjoining wall portion 59, and an obliquely extending wall portion 61 adjoining said wall portion 60. The coins to be debased are firmly engaged by said radially extending wall portion 59.

FIG. 11 shows a shredding device 101 according to the invention, which comprises a storage hopper 102 for coins to be debased and a funnel-shaped inlet channel 103 present above said storage hopper. Shredding device 101 furthermore comprises an upwardly sloping conveyor belt 104, with a first lower end 105 thereof being disposed in storage hopper 102 and an upper end 106 thereof being disposed above an inlet opening 107 of a distributor 108. Distributor 108 is provided with a grate shaped cover 109 and a rotor 110 disposed under said cover 109, which can be rotated about a horizontally extending axis 112 by means of a motor 111. Distributor 108 is furthermore provided with water sprayers 113, which are directed towards rotor 110. Present under distributor 108 are two assemblies 114, 115 extending parallel to each other, which assemblies are rotatable about horizontally extending axes 116, 118 in directions indicated by arrows P101, P102. A discharge container 118 is movably disposed under assemblies 114, 115.

FIG. 12 is a plan view, seen in the direction indicated by arrows XII—XII in FIG. 11, wherein assemblies 114, 115 are clearly shown. Each assembly 114, 115 comprises a number of annular knives 119 and cylinders 120 present between said knives, which knives and cylinders are jointly rotatable about axes 116, 117. Knives 119 of assembly 115 extend between knives 119 of assembly 114, to a position near cylinders 120, leaving open a gap 121. A similar gap 121 is present between cylinders 120 of assembly 115 and the opposite knives 119 of assembly 114.

FIG. 13 shows a detail of the view of FIG. 12, wherein the gap 121 present between the knives of the two assemblies and cylinder 120 is clearly shown. Said gap has a width B which is equal to the width of knives 119 and cylinder 120, and a length L which is equal to the distance between axes 116, 117, less the radius of cylinder 120 and the radius of knife 119. For the shredding of coins it is important that the diagonal distance D, which equals $\sqrt{(L^2+B^2)}$, is smaller than the smallest diameter of the coin to be shredded, so that no coin can pass through the two assemblies 114, 115 without being damaged.

FIG. 14 is a front view of the assembly of FIG. 12, seen in the direction indicated by arrows XIV—XIV therein, which clearly shows a cylinder 120 and an opposite knife 119. As is clearly shown in the figure, each knife 119 is provided with a number of notches 122. Knives 119 and cylinders 120 are mounted on a hexagonal shaft 123. Knives 119 are fixed with respect to hexagonal shaft 123, whilst cylinders 120 are rotatably mounted thereon.

Cylinders 120 can be replaced by cylinders having a different diameter, as a result of which the distance L of gap 121, and consequently the diagonal dimension D of gap 121, will be enlarged or reduced. This makes it possible to adapt device 101 in a relatively simple manner to the shredding of coins having different dimensions. The same effect can be achieved by making the distance between axes 116, 117 adjustable.

For shredding Hfl. 0.10 coins (diameter 14.86 mm), using a knife width B of 10 mm), a cylinder is selected whose diameter is such that the gap will have a length L of for example 3 mm, so that dimension D will be 10.44 mm. When Hfl. 2.50 coins (diameter 29.05 mm) are to be shredded, the cylinder dimension must be selected such that a distance L of for example 12.5 is obtained and therefore a distance D of about 16 mm is obtained.

Shredding device 101 is furthermore provided with a control unit (not shown), by means of which the velocity of conveyor belt 104, the rotational speed of motor 110 and the rotational speed of assemblies 114, 115 can be controlled in such a manner that a maximum amount of coins per unit time will be shredded without assemblies 114, 115 getting stuck as a result of the presence of an excessive amount of coins on assemblies 114, 115.

The operation of the shredding device 101 according to the invention will now be briefly explained. Sacks of coins are emptied into hopper 102 via inlet opening 103 under the supervision of an authorized person. The coins to be debased are then moved upwards in metered quantities by means of conveyor belt 104, until the coins fall from second end 106, via inlet opening 107, into distributor 108. In said distributor 108, the coins are evenly distributed by means of rotating rotor 110. During the shredding of the coins, a water spray is sprayed onto rotor 110 and assemblies 114, 115 by means of water sprayers 113 so as to dissipate heat, provide lubrication and cause metal dust particles to settle. The vapours produced thereby are carried off through grate shaped cover 109, for example by means of an exhaust plant. The coins then fall onto the knives 119 moving towards each other, and they are shredded in gap 121 by knives 119. Due to the presence of notches 122 in knives 119, the coins present on knives 119 are kept in motion and transported to gap 121. Keeping the coins in motion is important in order to prevent the assemblies 114, 115 from getting stuck.

The shredded coins that have been fed through assemblies 114, 115 will fall into discharge container 118, by means of which they can be transported to a melting furnace. No supervision is required during the transport of the shredded coins, since the coins no longer have a value as coins. If the coins are made of two different alloys, with a central portion consisting of a non-magnetisable material and a surrounding portion consisting of a magnetisable material, for example, it is possible to separate the two materials by means of a magnet, so that each material can be reused for the most suitable application. The same applies to a coin comprising a magnetisable central portion and a non-magnetisable surrounding portion.

To this end it is possible to use the device 125 which is shown in FIG. 16, which corresponds in large measure to the device 101 which is shown in FIG. 11. A horizontally extending endless conveyor belt 126 is disposed under assemblies 114, 115 in device 125, which conveyor belt is passed over driving rollers 127, 128. Belt 126 is provided with partitions 129 extending transversely to belt 126, which partitions are spaced out evenly along the length of conveyor belt 126. Belt 128 is made of a magnetic material.

Two containers 130, 131 are disposed under conveyor belt 126 and near roller 128. A V-shaped guide element 132 is positioned between containers 130, 131.

Shredded coins that have been fed through assemblies 114, 115 will fall onto conveyor belt 126 and be transported towards roller 128. Non-magnetisable coin parts will directly fall from roller 128 in the direction indicated by arrow P103 and land in container 130. The magnetisable coin parts will be attracted by magnetic roller 128 and they will not fall into container 130. Partitions 129 will carry said coin parts along when conveyor belt 126 moves on, and once said parts are no longer under the influence of roller 128, they will fall into container 131 in the direction indicated by arrow P104. As a result of the presence of V-shaped guide element 132, the coin parts will land in one of the containers 130, 131 at all times.

Instead of shredding the coins, it is also possible to debase the coins by making a hole in the coins, for example by means of a drilling or punching operation, or by cutting the coins into a number of separate parts. This makes it necessary, however, to feed the coins precisely one by one, which is relatively time-consuming.

It is also possible to press the shredded coins together into one metal block after shredding, thus reducing the volume to be transported.

It is also possible to fix cylinders 120 with respect to shaft 123.

Furthermore it is possible to provide one roll with a smooth surface and to provide the opposite roll with relatively deep teeth. It is thereby preferred to provide the roll having the relatively large diameter with a smooth surface and to provide the roll having the relatively small diameter with teeth.

Furthermore it is possible to give both rolls a smooth surface, whereby the coins are flattened out as a result of the exertion of a relatively large force.

Instead of using profiles 22 extending in circumferential direction, it is also possible to use profiles extending in axial direction.

Preferably, the profiles are configured such that the coin will break on folding lines 36 when it is attempted to return a debased coin to its original condition.

It is possible to debase for example 100 coins per second by means of the device according to the invention.

What is claimed is:

1. A method for debasing coins, characterized in that each coin is fed through at least two rolls rotating in opposite directions, whereby at least one roll is provided with a corrugated profile as a result of which the coins are deformed into a corrugated shape.

2. A method according to claim 1, characterized in that said rolls are provided with opposed corrugated profiles.

3. A method according to claim 1 or 2, characterized in that said corrugated profile comprises teeth extending in the circumferential direction of the roll as well as teeth extending in the axial direction of the roll.

4. A method according to claim 3, characterized in that the teeth extending in the axial direction of the roll each comprise a radially extending wall portion, a tangentially extending wall portion adjoining said wall portion, and an adjoining wall portion extending at an angle thereto, which latter wall portion adjoins the radially extending wall portion of adjacent teeth, wherein the radially extending wall portion is positioned in front, seen in the direction of rotation of the roll.

5. A method according to claim 3 or 4, characterized in that the spacing between the teeth on a roll is selected in dependence on the dimension of the coins to be devalued.

6. A method according to any one of the preceding claims, characterized in that the spacing between the rolls is adjustable.

7. A method according to any one of the preceding claims, characterized in that the deformed coins are melted.

8. A device suitable for carrying out the method according to any one of the preceding claims, characterized in that said device comprises at least two rolls rotating in opposite directions, with at least one roll having a corrugated profile and with the spacing between the rolls being adjustable, a feeding device for feeding coins to be debased to the rolls, and a discharge device for carrying the debased coins away from the roll.

9. A device according to claim 8, characterized in that the both rolls are provided with a corrugated profile, which corrugated profiles are positioned opposite each other.

10. A device according to claim 9, characterized in that said corrugated profile comprises teeth extending in the circumferential direction of the roll as well as teeth extending in the axial direction of the roll.

11. A device according to claim 10, characterized in that the teeth extending in the axial direction of the roll each comprise a radially extending wall portion, a tangentially extending wall portion adjoining said wall portion, and an adjoining wall portion extending at an angle thereto, which adjoins the radially extending wall portion of adjacent teeth, wherein the radially extending wall portion is positioned in front, seen in the direction of rotation of the roll.

12. A device according to claim 10 or 11, characterized in that the spacing between the teeth on a roll is selected in dependence on the dimension of the coin to be devalued.

13. A device according to any one of the preceding claims 8–12, characterized in that the spacing between the rolls is adjustable.

14. A device according to any one of the preceding claims 8–13, characterized in that at least one scraper is positioned opposite at least one roll, which scraper is provided with a profile which engages in the corrugated profile of said roll.

15. A device according to any one of the preceding claims 8–14, characterized in that the device is provided with a feeding device for feeding coins in metered quantities through said rolls.

16. A coin debased in accordance with a method according to any one of the preceding claims 1–6, characterized in that said coin is provided with a corrugated profile.

17. A coin according to claim 16, characterized in that said coin is provided with at least one imprint of teeth.

* * * * *